US006599392B1

(12) United States Patent
Tadokoro et al.

(10) Patent No.: US 6,599,392 B1
(45) Date of Patent: Jul. 29, 2003

(54) PAPER BULKING PROMOTER

(75) Inventors: Takaaki Tadokoro, Wakayama (JP); Yasushi Ikeda, Wakayama (JP); Takayuki Ikenaga, Wakayama (JP); Atsuhito Mori, Wakayama (JP); Yoichi Ishibashi, Wakayama (JP); Yasuo Ishii, Wakayama (JP); Toshiyuki Nishimori, Wakayama (JP); Hiromichi Takahashi, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 09/463,905

(22) PCT Filed: Jun. 2, 1999

(86) PCT No.: PCT/JP99/02947

§ 371 (c)(1),
(2), (4) Date: Feb. 2, 2000

(87) PCT Pub. No.: WO99/63156

PCT Pub. Date: Dec. 9, 1999

(30) Foreign Application Priority Data

Jun. 2, 1998 (JP) ..... 10-152814

(51) Int. Cl.[7] ..... D21H 21/22
(52) U.S. Cl. ..... 162/158; 162/179
(58) Field of Search ..... 162/158, 179

(56) References Cited

U.S. PATENT DOCUMENTS 4,303,471 A * 12/1981 Laursen ..... 162/158
5,292,363 A * 3/1994 Hutcheson ..... 162/158
5,429,718 A * 7/1995 Morlino et al. ..... 162/72
5,716,692 A * 2/1998 Warner et al. ..... 428/153
5,776,308 A * 7/1998 Sears et al. ..... 162/158
5,858,172 A * 1/1999 Sears et al. ..... 162/158

FOREIGN PATENT DOCUMENTS

| | | | |
|---|---|---|---|
| DE | 42 02 703 | A1 | 8/1993 |
| DE | 4202703 | A | 8/1993 |
| EP | 0930394 | A1 | 7/1999 |
| GB | 2268941 | A | 1/1994 |
| JP | 57101096 | A | 6/1998 |
| WO | WO 94/05856 | | 3/1994 |
| WO | 9803730 | A1 | 1/1998 |

OTHER PUBLICATIONS

Casey, Pulp and Paper, 3rd ed., vol. !!! (1981) p 1561.*
Casey, Pulp and Paper, vol. III, 3rd ed., (1981), pp. 1587 and 1588.*

* cited by examiner

*Primary Examiner*—Peter Chin
(74) *Attorney, Agent, or Firm*—Birch, Stewart, Kolasch & Birch, LLP

(57) ABSTRACT

According to the present invention, a bulky sheet can be obtained without reducing the effect of a sizing agent. Thus, an ester compound having the melting point of not more than 100° C. selected from (A) an ester compound of a polyhydric alcohol and a fatty acid and (B) an ester compound of a polyhydric alcohol and a fatty acid further including from more than 0 mole to less than 12 moles on the average of $C_{2-4}$ oxyalkylene groups per 1 mole of the said ester compound is used as a paper bulking promoter.

15 Claims, No Drawings

PAPER BULKING PROMOTER

This application is the national phase under 35 U.S.C. §371 of PCT International Application No. PCT/JP99/02947 which has an International filing date of Jun. 2, 1999, which designated the United States of America.

TECHNICAL FIELD

This invention relates to a paper bulking promoter with which sheets of paper obtained from a pulp feedstock can be bulky without reducing the effect of a sizing agent.

BACKGROUND ART

Recently, there is a desire for high-quality paper, e.g., paper excellent in printability and voluminousness. Since the printability and voluminousness of paper are closely related to the bulkiness thereof, various attempts have been made to improve bulkiness. However pulp recycling is made to be impossible as well as smoothness of a paper is made to be impaired. Although a paper bulking promoter containing a certain alcohol and/or a polyoxyalkylene adduct thereof was also disclosed (WO98/03730), it may be associated with an insufficiency in exerting the effect of a sizing agent employed generally in combination. Furthermore, a bulking promoter, which is a fatty acid polyamide polyamine, is an available commercially, but has only a limited performance.

DISCLOSURE OF THE INVENTION

An object of the present invention is to provide a paper bulking promoter by which sufficient bulking effect can be obtained even when the bulking promoter is added in a small amount and which does further not reduce the performance of a sizing agent added in paper-preparing step.

Thus, the invention provides a paper bulking promoter comprising an ester compound having the melting point of not more than 100° C. selected from (A) an ester compound of a polyhydric alcohol and a fatty acid and (B) an ester compound of a polyhydric alcohol and a fatty acid further including from more than 0 mole to less than 12 moles on the average of $C_{2-4}$ alkylene oxide (hereinafter referred as OA) groups per 1 mole of the said ester compound.

INDUSTRIAL APPLICABILITY

According to the paper bulking promoter of the present invention, an excellent bulking effect can be obtained even when the paper bulking promoter is added in a small amount, and a bulky sheet can be obtained without impairing an effect of a sizing agent.

MODE FOR CARRYING OUT THE INVENTION

An ester compound of the paper bulking promoter in the present invention is:

(A) an ester compound of a polyhydric alcohol and a fatty acid (an ester compound having no OA group) having the melting point of not more than 100° C., or, (B) an ester compound of a polyhydric alcohol and a fatty acid, further including from more than 0 mole to less than 12 moles on the average of $C_{2-4}$ OA groups per 1 mole of the said ester compound and having the melting point of not more than 100° C.

Both members as (A) and (B) of these esters may be used in combination, and two or more of each member of esters may also be used.

A polyhydric alcohol as a constituent of an ester compound in the present invention is preferably a 2- to 14-hydric alcohol having 2 to 24 carbon atoms in total which may contain an ether group. A 2-hydric (dihydric) alcohol may be one which has 2 to 10 carbon atoms in total and which may contain an ether group, such as propylene glycol, dipropylene glycol, butylene glycol, dibutylene glycol, ethylene glycol, diethylene glycol and polyethylene glycol. Then, 3-(tri) or more hydric alcohol may be one which has 3 to 24 carbon atoms in total, which may contain an ether group and wherein the total number of hydroxy group/the total number of carbon atoms=0.4 to 1 in one molecule, such as glycerol, poly(n=2 to 5)glycerol, pentaerythritol, dipentaerythritol, arabitol, sorbitol, stachyose, erythrite, arabite, mannite, glucose and sucrose. Preferably, there are ethylene glycol, diethylene glycol, propylene glycol, and an alcohol which has 3 to 12 carbon atoms in total, which may contain an ether group, wherein the total number of hydroxy group/the total number of carbon atoms=0.5 to 1 in one molecule, and which is 3- or more hydric alcohol. More preferably, there are glycerol, poly (n=2 to 4) glycerol and pentaerythritol.

Further, a fatty acid constituting an ester compound of the present invention may be a fatty acid having 1 to 24 carbon atoms, preferably 10 to 22 carbon atoms. It may be any one of saturated, unsaturated, linear and branched one. A linear saturated fatty acid is particularly preferable. More preferably, there are lauric acid, stearic acid, palmitic acid, myristic acid and behenic acid.

The ester compound of the present invention may be obtained by carrying out of conventionally known esterification and adding of alkylene oxide. For example, a mixture of a fatty acid and a polyhydric alcohol is, if necessary, admixed with an esterification catalyst and reacted at 150 to 250° C. to obtain an ester compound (A), to which an alkylene oxide is added in the presence of an alkaline catalyst, whereby obtaining an alkylene oxide adduct (B). Alternatively, an esterification reaction may be carried out, after an alkylene oxide is added to a fatty acid or a polyhydric alcohol. Furthermore, it can be sometimes obtained by only adding an alkylene oxide to a fatty acid, too.

The average esterification degree of an ester compound in the present invention is more than 0. Preferably, per 1 mole of a polyhydric alcohol, OH in the alcohol has been esterified in an amount of 10 to 95% by equivalent. An alcohol has particularly preferably 1 to 2 moles of a fatty acid group per 1 mole of polyhydric alcohol.

When an ester compound (B) containing an OA group having 2 to 4 carbon atoms is used as a paper bulking promoter of the present invention, the number thereof (OA group) is on the average from more than 0 to less than 12 moles, preferably not more than 6 moles, and actually preferably 0.1 to 6 moles, per 1 mole of the ester compound. When a polyhydric alcohol, which can become an OA group, such as ethylene glycol, is used, the mole numbers thereof are also counted as the number of OA groups. An OA group is formed by adding an alkylene oxide having 2 to 4 carbon atoms. A preferred alkylene oxide is ethylene oxide (EO) or propylene oxide (PO). These may be used as any one of EO, PO and a mixture of EO and PO. In the present invention, it is particularly preferable to use an ester compound containing no OA group as a paper bulking promoter.

An ester compound of the present invention has HLB of preferably 1 to 14, more preferably 1.5 to 10, further preferably 2 to 8. HLB is an index for the hydrophilicity of a surfactant. The larger the value of HLB is, the higher the hydrophilicity becomes. In the present invention, the HLB of each compound is calculated by the following formula according to Griffin's method.

$$HLB = \frac{\text{Molecular weight of hydrophilic group moiety}}{\text{Molecular weight of ester compound}} \times 20$$

And, in the present invention, a hydrophilic group means the following group in an ester compound.

(1) —$(CH_2CH_2O)m$—

(2) —$(RO)_n$— [R: alkylene group having 3 to 4 carbon atoms, n<2.0, wherein n is a total number in one molecule]

For example, the underlined part in RCOO—$(PO)_{1-5}H$ represents a hydrophilic group. On the other hand, the underlined part in RCOO—$(PO)_{2-0}H$ represents a hydrophobic group.

Further, in the case of the following formula:

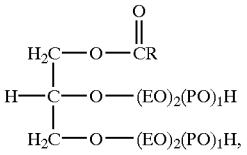

any PO group is a hydrophobic group since one molecule contains 2 moles of PO in total.

(3) A group derived from an alcohol which may have an ether group, which is a 3- or more hydric alcohol having 3 to 24 carbon atoms in total, and wherein the total number of hydroxy group/the total number of carbon atoms=0.4 to 1 in one molecule.

(4) An oxygen atom adjacent to a carbonyl group.

An ester compound of the present invention has the melting point of 100° C. or lower, preferably −15° C. or higher and 80° C. or lower, more preferably 20° C. or higher and 70° C. or lower, from the viewpoint of handleability and preserving a sizing performance. The melting point is made to be a temperature of peak beginning, when a solid ester compound pre-cooled is measured (temperature raising ratio of 2° C./minute) by a differential scanning calorimeter (DSC).

An ester compound of the present invention is preferably one having HLB of 2 to 8 and the melting point of 10 to 70° C., and more preferably one having HLB of 2 to 7 and the melting point of 45 to 70° C. Within such range, more preferable results of the bulk promoting effect and the sizing effect (maintained effect of a sizing agent) can be obtained.

A paper bulking promoter of the present invention is added at any step of papermaking. When it is a liquid product, it may be added as it is. Then, when it is a solid product, it may be added after pulverizing, fusing by heat or diluting with water etc. Further, if necessary, a nonionic, anionic, cationic and polymeric surfactant, and preferably a nonionic surfactant, may be used as an emulsifier or dispersant. In such case, the ratio of a paper bulking promoter in the present invention and a surfactant is: [a paper bulking promoter of the present invention]/surfactant=99.5/0.5 to 70/30 (by weight), preferably 98/2 to 80/20.

The bulking promoter of the present invention is applicable to a variety of ordinary pulp feedstocks ranging from virgin pulps such as mechanical pulps including TMP (thermomechanical pulp) and chemical pulps including LBKP (bleached hardwood pulp) to pulps prepared from various waste papers. The point where the bulking promoter of the present invention is added is not particularly limited as long as it is within the papermaking step. The papermaking step is to form paper layers by draining water from a diluted liquid of a pulp feedstock throughout the advance thereof on a wire netting. In a factory, for example, the bulking promoter is desirably added at a point where it can be evenly blended with a pulp feedstock, such as, refiner, machine chest, or headbox. After the bulking promoter of this invention is added to a pulp feedstock, the resultant mixture is subjected as it is to sheet forming. The bulking promoter remains in the paper. The paper bulking promoter of this invention is added in an amount of 0.01 to 10% by weight, preferably 0.1 to 5% by weight, based on the pulp feedstock. But, in the case of some system, an excellent bulking effect can be obtained by adding a small amount of 0.1 to 1% by weight.

The pulp sheet obtained by using the paper bulking promoter of the present invention has a bulk density (the measurement method is shown in the Examples given later) lower by preferably at least 5%, more preferably at least 7%, than the product not containing the paper bulking promoter.

At the time of papermaking, it is allowable to add a sizing agent such as a rosin, an alkyl ketene dimer, gelatin, starch and latex, moreover a filler, a yield improver, a drainability improver, a paper strength improver, and the like. A sizing agent fills voids on the surface or bulk of the paper with a water-proof material to suppress the permeation of water or inks, and can be used for paper-treatment by adding to a pulp slurry (inner sizing) or coating onto a resultant paper (surface sizing). A sizing agent is added usually in an amount of 0.01 to 1.0% by weight based on a pulp feedstock, although the amount may vary depending on the types of the paper. Since a paper bulking promoter of the present invention is excellent also in preserving a sizing performance, it is applied preferably to a method for producing an obtainable highly bulky pulp sheet using a sizing agent in combination.

EXAMPLES

Examples 1 to 22 and Comparative Examples 1 to 9

[Pulp Feedstock]

The deinked pulp and the virgin pulp shown below were used as pulp feedstocks.

<Deinked Pulp>

A deinked pulp was obtained in the following manner. To feedstock waste papers collected in the city (newspaper/leaflet=70/30%) were added warm water, 1% (based on the feedstock) of sodium hydroxide (based by weight, this is true hereinafter), 3% (based on the feedstock) of sodium silicate, 3% (based on the feedstock) of a 30% aqueous hydrogen peroxide solution, and 0.3% (based on the feedstock) of EO/PO block adduct of beef tallow/glycerol (1:1), as a deinking agent, in which the amounts of EO and PO were respectively 70 and 10 (average number of moles added). The feedstock was brushed out and then subjected to flotation. The resultant slurry was washed with water and regulated to a concentration of 1% to prepare a deinked pulp slurry. This had a freeness of 220 ml.

<Virgin Pulp>

A virgin pulp was prepared by brushing out and beating an LBKP (bleached hardwood pulp) with a beater at room temperature to give a 1% LBKP slurry. This had a freeness of 420 ml.

[Papermaking Method]

Each of the above 1% pulp slurries was weighed out in such an amount as to result in a sheet of paper having a basis weight of 60 g/m$^2$. The pH thereof was adjusted to 4.5 with aluminum sulfate. Subsequently, various bulking promoters shown in Table 1 and 2 were added in amount of 0.8% based on the pulp, besides rosin sizes as sizing agent were added in amount of 0.5% based on the pulp. Each resultant mixture was stirred, and was formed into a sheet with a rectangular TAPPI paper machine using an 80-mesh wire. The sheet obtained was pressed with a press at 3.5 kg/cm$^2$ for 2 minutes and dried with a drum dryer at 105° C. for 1 minute. After each dried sheet was held the conditions of 20° C. and a humidity of 65% for 1 day to regulate its moisture content, it was evaluated for bulk density and sizing degree by the following methods. The found value was an average of 10 measurements. The results are shown in Table 3.

<Evaluation Item and Method>

Bulkiness (Bulk Density)

The basis weight (g/m$^2$) and thickness (mm) of each sheet having a regulated moisture content were measured, and its bulk density (g/cm$^3$) was determined by the following calculation.

Equation for calculation:

$$\text{Bulkiness (bulk density)}=(\text{basis weight})/(\text{thickness})\times 0.001$$

The smaller the absolute value of bulk density is, the higher the bulkiness is. A difference of 0.02 in bulk density is sufficiently recognized as a significant difference.

Sizing-ability

The sizing performance was evaluated as directed in JIS P 8122-54 using Stöckigt sizing degree determination method. Thus, a 2 cm×2 cm test piece of a paper obtained after the sheet formation process was floated on a 2% solution of ammonium thiocyanate at 20±1° C. contained in a petri dish and treated with dropwise addition of a 1% solution of ferric chloride at the same temperature using a pipette, and the time period until three red spots appeared on the test piece was determined as the number of seconds, which represented the sizing degree. It is advantagoues industrially to keep the sizing degree of 80% of that of a blank (Comparative 1) or higher.

TABLE 1

| | Paper bulking promoter | | | | |
|---|---|---|---|---|---|
| Examples | Ester compound | AO type and number of moles added | AO of addition form | HLB | Melting point (° C.) |
| 1 | Ethylene glycol monolaurate | — | — | 5.0 | −2 |
| 2 | Stearic acid monoglyceride | — | — | 5.1 | 66 |
| 3 | Pentaerythritol monostearate | — | — | 6.7 | 52 |
| 4 | Propylene glycol sesquipalmitate | — | — | 3.7 | 41 |
| 5 | Sorbitan monomyristate | — | — | 8.7 | 30 |
| 6 | Arabitol dioleate | — | — | 4.4 | 25 |
| 7 | Soribitol trilaurate | — | — | 4.9 | 11 |
| 8 | Saccharose monooleate | — | — | 11.3 | 59 |
| 9 | Ethylene glycol monobehenate | — | — | 3.2 | 64 |
| 10 | Diglycerol monomyristate | — | — | 8.8 | 52 |
| 11 | Dipentaerythritol dipalmitate | — | — | 6.9 | 49 |
| 12 | Triglycenrol sesquioleate | — | — | 7.8 | 12 |
| 13 | Tetraglycerol monostearate | — | — | 10.8 | 61 |
| 14 | Ethylene glycol monooleate | EO 1 mole | — | 5.7 | −3 |
| 15 | Lauric acid monoglyceride | PO 0.4 mole | — | 7.7 | 45 |
| 16 | Pentaerythritol monomyristate | EO 2 moles PO 2 moles | Block | 8.1 | 18 |
| 17 | Propylene glycol monopalmitate | EO 1.5 moles PO 4 moles | Random | 4.6 | 13 |
| 18 | Sorbitan monolaurate | EO 6 moles | — | 14.0 | −4 |
| 19 | Xylitol monostearate | PO 2 moles | — | 5.7 | 41 |
| | | EO 6 moles | Block | 8.4 | 5 |
| 20 | Mannitol sesquioleate | PO 4 moles | | | |
| 21 | Diethylene glycol monodecylate | EO 2 moles PO 5 moles | Random | 6.0 | −1 |
| 22 | Emulsified product of Example 3 | — | — | — | — |

The molar number of AO (Alkylene Oxide) added is an average number of AO moles added per 1 mole of an ester compound.

In the case of block addition, addition is conducted with EO and then with PO.

(Note) The composition of Example 22 represents a 10% emulsion of Example 3/Polyoxyethylene (average number of EO moles added: 10) sorbitan monolaurate=95/5 (by weight).

TABLE 2

| Comparative Examples | Paper bulking promoter: Ester compound | AO type and number of moles added | AO of addition form | HLB | Melting point (° C.) |
|---|---|---|---|---|---|
| 1 | Blank (containing no bulking promoter) | — | — | — | — |
| 2 | Lauryl alcohol | EO 3 moles PO 1 mole | Block | 11.0 | 5 |
| 3 | $C_{12-13}$ oxoalcohol | EO 1.5 moles | — | 6.4 | −2 |
| 4 | 80/20 (by weight) mixture of decyl alcohol/30 moles of EO adduct to sorbitan trioleate | — | — | 4.3 | 2 |
| 5 | Sorbitol tetraoleate | EO 30 moles | — | 11.7 | −10 |
| 6 | Sorbitan monopalmitate | EO 20 moles | — | 16.3 | −14 |
| 7 | Commercial bulking promoter "Bayvolume P Liquid" (fatty acid polyamide polyamine type; manufactured by Bayer AG) | — | — | — | — |
| 8 | Sorbitan monooleate | EO 12 moles | — | 14.5 | −5 |
| 9 | Distearyl phthalate | — | — | 1.0 | 45 |

The number of AO (Alkylene Oxide) moles added is an average number of added moles per 1 mole of monomer ester.

In the case of block addition, addition is conducted with EO, and then with PO.

TABLE 3

| | Deinked pulp | | LBKP | |
|---|---|---|---|---|
| | Bulk density ($g/cm^3$) | Sizing degree (second) | Bulk density ($g/cm^3$) | Sizing degree (second) |
| | | Examples | | |
| 1 | 0.339 | 58 | 0.382 | 66 |
| 2 | 0.315 | 73 | 0.361 | 82 |
| 3 | 0.313 | 72 | 0.360 | 82 |
| 4 | 0.327 | 67 | 0.372 | 76 |
| 5 | 0.330 | 64 | 0.376 | 72 |
| 6 | 0.331 | 63 | 0.377 | 71 |
| 7 | 0.335 | 61 | 0.377 | 67 |
| 8 | 0.326 | 70 | 0.369 | 78 |
| 9 | 0.318 | 72 | 0.362 | 82 |
| 10 | 0.320 | 71 | 0.364 | 81 |
| 11 | 0.324 | 69 | 0.367 | 78 |
| 12 | 0.336 | 62 | 0.378 | 67 |
| 13 | 0.317 | 72 | 0.363 | 81 |
| 14 | 0.340 | 57 | 0.384 | 66 |
| 15 | 0.322 | 69 | 0.366 | 78 |
| 16 | 0.338 | 62 | 0.380 | 70 |
| 17 | 0.337 | 62 | 0.379 | 69 |
| 18 | 0.344 | 56 | 0.388 | 65 |
| 19 | 0.328 | 68 | 0.373 | 76 |
| 20 | 0.339 | 59 | 0.383 | 68 |
| 21 | 0.341 | 57 | 0.385 | 67 |
| 22 | 0.313 | 71 | 0.360 | 82 |
| | | Comparative examples | | |
| 1 | 0.376 | 70 | 0.413 | 80 |
| 2 | 0.362 | 0 | 0.404 | 0 |
| 3 | 0.362 | 9 | 0.405 | 10 |
| 4 | 0.365 | 0 | 0.406 | 0 |
| 5 | 0.367 | 0 | 0.407 | 0 |
| 6 | 0.363 | 0 | 0.404 | 0 |
| 7 | 0.372 | 0 | 0.411 | 0 |
| 8 | 0.360 | 8 | 0.403 | 10 |
| 9 | 0.373 | 15 | 0.412 | 17 |

What is claimed is:

1. A method for producing a highly bulky pulp sheet, said method comprising adding a paper bulking promoter to a pulp feedstock in a papermaking process in the amount of 0.1 to 10% by weight based on the pulp feedstock;

wherein said paper bulking promoter comprises an ester compound having the melting point of not more than 100° C., selected from (A) an ester compound of a polyhydric alcohol and a fatty acid and (B) an ester compound of a polyhydric alcohol and a fatty acid further including from more than 0 mole to less than 12 moles on the average of $C_{2-4}$ oxyalkylene groups per 1 mole of the said ester compound; wherein 10 to 95% by equivalent of OH groups of the alcohol have been esterified.

2. A method as claimed in claim 1 wherein a sizing agent is further added to a pulp feedstock in a papermaking process.

3. The method for producing a highly bulky pulp sheet of claim 1, wherein a sizing agent and a surfactant are added to said pulp feedstock in the papermaking process.

4. The method of claim 1, wherein the fatty acid of said paper bulking promoter has 10 to 22 carbon atoms.

5. The method of claim 1, wherein the ester compound of said paper bulking promoter has an HLB of 1 to 14.

6. A highly bulky pulp sheet produced by the method of claim 1.

7. The method of claim 1, wherein said paper bulking promoter is added to the pulp feedstock in the amount of 0.1 to 1% by weight based on the pulp feedstock.

8. The method of 1, further comprising the steps of forming paper layers by draining water from a diluted liquid of the pulp feedstock, and forming said highly bulky pulp sheet.

9. The method of 1, further comprising the step of forming a sheet, wherein said bulking promoter remains in the paper.

10. The method of 1, wherein said pulp feedstock is deinked pulp or virgin pulp.

11. The method of claim 3, wherein said sizing agent is added in the amount of 0.1 to 1.0% by weight based on the pulp feedstock.

12. The method of claim 1, wherein the polyhydric alcohol of said paper bulking promoter is a 2- to 14-hydric alcohol having 2 to 24 carbon atoms in total which may contain an ether group.

13. The method of claim 1, wherein the fatty acid of said paper bulking promoter is a fatty acid having 1 to 24 carbon atoms.

14. The method of claim 1, wherein the ester compound of said paper bulking promoter contains no oxyalkylene group.

15. The method of claim 1, wherein said highly bulky pulp sheet is printable.

* * * * *